US007270138B2

(12) United States Patent
Liao

(10) Patent No.: US 7,270,138 B2
(45) Date of Patent: Sep. 18, 2007

(54) JOINT MECHANISM

(76) Inventor: Hsueh-Hu Liao, 8319 Allport Ave., Santa Fe Springs, CA (US) 90670

( * ) Notice: Subject to any disclaimer, the term of this patent is extended or adjusted under 35 U.S.C. 154(b) by 717 days.

(21) Appl. No.: 10/691,449

(22) Filed: Oct. 22, 2003

(65) Prior Publication Data

US 2004/0107983 A1 Jun. 10, 2004

Related U.S. Application Data

(60) Provisional application No. 60/494,941, filed on Aug. 13, 2003, provisional application No. 60/420,245, filed on Oct. 22, 2002.

(51) Int. Cl.
*A45B 9/04* (2006.01)
*A61H 3/02* (2006.01)

(52) U.S. Cl. ..... 135/82; 135/84; 135/86; 403/229

(58) Field of Classification Search ..... 403/221, 403/223, 225, 229, 109.3; 135/82, 84, 114, 135/86

See application file for complete search history.

(56) References Cited

U.S. PATENT DOCUMENTS

| | | | | |
|---|---|---|---|---|
| 434,708 | A | 8/1890 | Grier | |
| 568,557 | A | 9/1896 | Avery | |
| 1,013,410 | A * | 1/1912 | Lynch | 403/229 |
| 1,485,036 | A * | 2/1924 | Kingsley | 464/57 |
| 1,674,983 | A * | 6/1928 | Morton | 403/146 |
| 1,761,502 | A * | 6/1930 | Sullivan | 135/82 |
| 1,895,229 | A * | 1/1933 | Morton | 403/229 |
| 2,306,638 | A * | 12/1942 | Meisler | 43/18.1 R |
| 2,351,145 | A | 6/1944 | Pearson | |
| 2,419,105 | A * | 4/1947 | Allan | 135/84 |
| 2,705,637 | A | 4/1955 | Hranicka | |
| 2,888,022 | A * | 5/1959 | Fanning | 135/82 |
| 3,275,319 | A | 9/1966 | Rost | |
| 3,365,195 | A | 1/1968 | Hansburg | |
| 3,437,059 | A * | 4/1969 | James et al. | 108/151 |
| 3,441,272 | A | 4/1969 | Mann | |
| 3,660,920 | A | 5/1972 | Spina | |
| 3,735,980 | A | 5/1973 | Weiss | |
| 4,032,140 | A | 6/1977 | Davis et al. | |

(Continued)

FOREIGN PATENT DOCUMENTS

| | | |
|---|---|---|
| WO | WO91/11222 | 8/1991 |

OTHER PUBLICATIONS 1 page definition of "bushing" from www.dictionary.com search May 26, 2007.*

*Primary Examiner*—Robert Canfield
(74) *Attorney, Agent, or Firm*—Eric Karich

(57) ABSTRACT

A joint mechanism for use in a rod for bearing at least a portion of a user's weight and a corresponding flexible tip for contacting a substantially horizontal surface. The joint mechanism includes a spring mechanism, a first bushing, and a second bushing. The spring member has opposed first and second ends. The first bushing is adapted for positioning in a hole in an end of the rod and has a cavity adapted to receive the first end of the spring member. The second bushing is adapted for positioning in a hole in the flexible tip and has a cavity adapted to receive the second end of the spring member.

9 Claims, 6 Drawing Sheets

U.S. PATENT DOCUMENTS

| | | | | | |
|---|---|---|---|---|---|
| D256,260 | S | | 8/1980 | Lay, Jr. | |
| 4,332,399 | A | * | 6/1982 | Kepple | 280/819 |
| 4,510,957 | A | * | 4/1985 | Frank | 135/84 |
| 4,636,109 | A | * | 1/1987 | Clausen et al. | 404/10 |
| 4,958,651 | A | * | 9/1990 | Najm | 135/82 |
| 5,074,548 | A | | 12/1991 | Sawyer | |
| 5,088,513 | A | * | 2/1992 | Ostermeyer | 135/82 |
| 5,123,311 | A | * | 6/1992 | Dymek | 81/177.6 |
| 5,445,471 | A | * | 8/1995 | Wexler et al. | 403/220 |
| 5,509,874 | A | | 4/1996 | Shih | |
| 5,865,204 | A | * | 2/1999 | Bracy | 135/82 |
| 6,055,998 | A | * | 5/2000 | Bader | 135/69 |
| 6,267,529 | B1 | * | 7/2001 | Mudryk et al. | 404/10 |
| 6,328,047 | B1 | * | 12/2001 | Lee | 135/20.1 |
| 6,374,841 | B1 | * | 4/2002 | Yamamoto et al. | 135/77 |
| 6,382,596 | B1 | * | 5/2002 | D'Ath | 256/11 |
| 6,488,717 | B1 | * | 12/2002 | McColl et al. | 623/35 |
| 6,883,530 | B2 | * | 4/2005 | Kawakami | 135/84 |
| 7,108,445 | B2 | * | 9/2006 | Henriques | 403/202 |
| 2002/0170587 | A1 | * | 11/2002 | Uemura | 135/65 |

* cited by examiner

JOINT MECHANISM

CROSS-REFERENCE TO RELATED APPLICATIONS

This application for a utility patent claims the benefit of U.S. Provisional Application No. 60/420,245, filed Oct. 22, 2002, and U.S. Provisional Application No. 60/494,941, filed Aug. 13, 2003. The previous applications are hereby incorporated by reference in their entirety.

STATEMENT REGARDING FEDERALLY SPONSORED RESEARCH

Not Applicable

BACKGROUND OF THE INVENTION

1. Field of the Invention

This invention relates generally to walking aids, and more particularly to walking aids having one or more rods for bearing some or all of a user's weight and corresponding flexible tips for contacting substantially horizontal surfaces.

2. Description of Related Art

Well known walking aids include crutches and canes. In general, a crutch is a staff or support used by a person with a physical injury or disability as a walking aid. Known types of crutches include underarm crutches, forearm crutches, and platform crutches. Underarm and forearm crutches are often used in pairs. A cane is generally a rod used by a physically injured or disabled person as a walking aid.

Other related devices include stilts and similar devices. Such devices are not typically used for medical purposes, but merely for amusement and/or entertainment.

It would be advantageous to have a crutch, stilt, or similar device with a reduced degree of mechanical stiffness and/or an improved ability to grip horizontal surfaces.

SUMMARY OF THE INVENTION

The present invention teaches certain benefits in construction and use which give rise to the objectives described below.

The present invention provides a joint mechanism for use in a rod for bearing at least a portion of a user's weight and a corresponding flexible tip for contacting a substantially horizontal surface. The joint mechanism includes a spring mechanism, a first bushing, and a second bushing. The spring member has opposed first and second ends. The first bushing is adapted for positioning in a hole in an end of the rod and has a cavity adapted to receive the first end of the spring member. The second bushing is adapted for positioning in a hole in the flexible tip and has a cavity adapted to receive the second end of the spring member.

A primary objective of the present invention is to provide a joint mechanism having advantages not taught by the prior art.

Another objective is to provide a joint mechanism with a reduced degree of mechanical stiffness, that is able to rotate and pivot in use Another objective is to provide a joint mechanism that enables the user to twist off the flexible tip for easy replacement of the flexible tip once it has become worn.

A further objective is to provide a joint mechanism with an improved ability to grip horizontal surfaces Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
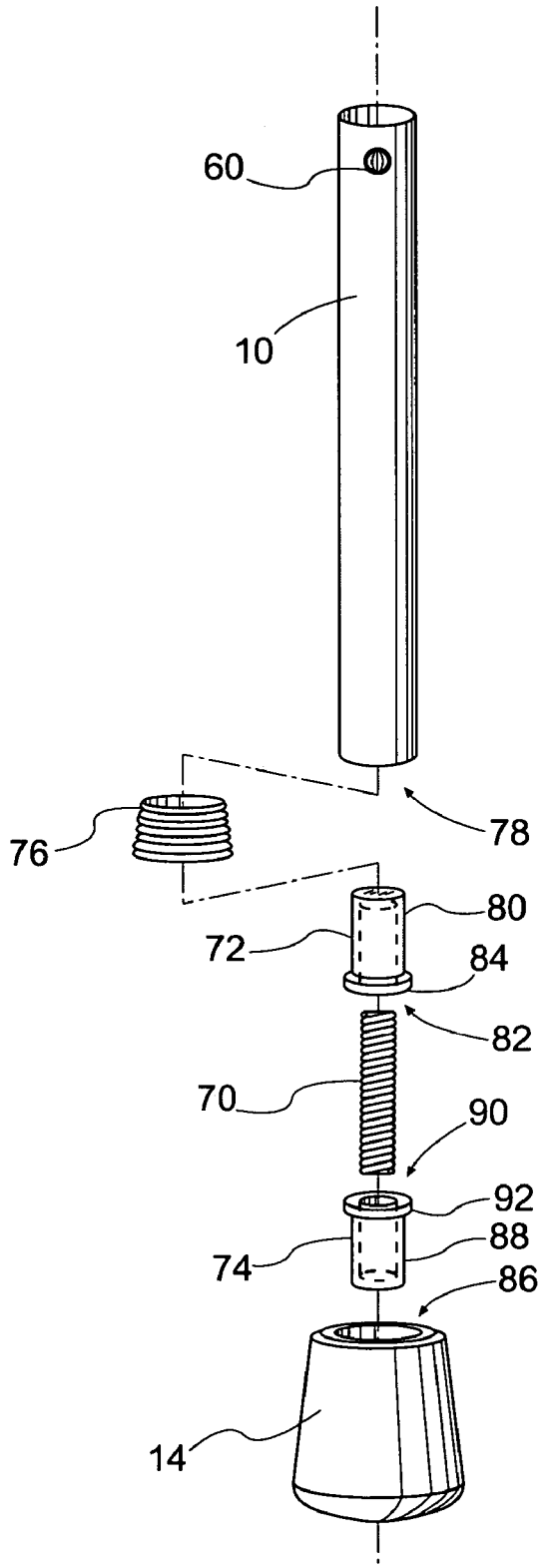
FIG. 1 is an exploded view of a preferred embodiment of a joint mechanism used to connect a rod and a flexible tip.

FIG. 1 is an exploded view of one embodiment of a rod 10, a joint mechanism 12, and a flexible tip 14 that provide the benefits described above. The rod 10 may be constructed in wide variety of shapes and sizes, and is preferably a rigid tubular construction, often made of aluminum, steel, or similar material. The specific construction of the rod 10 will vary depending upon the nature of the device that incorporates the joint mechanism 12. Two specific embodiments are described below.

The joint mechanism 12 includes a coil spring 70, an upper bushing 72, a lower bushing 74, and preferably also includes a dust cover 76. The rod 10 has a hole 78 (aperture, depression, or similar structure) dimensioned to receive a body 80 of the upper bushing 72. The body 80 of the upper bushing 72 has a cavity 82 dimensioned to receive an upper end of the coil spring 70. The cavity 82 is dimensioned to receive an upper half of the coil spring 70. The upper bushing 72 has a flange 84 surrounding an opening of the cavity 82 for contacting a surface of the end of the rod 10 surrounding the hole 78.

The flexible tip 14 has a hole 86 in an upper surface dimensioned to receive a body 88 of the lower bushing 74. The body 88 of the lower bushing 74 has a cavity 90 dimensioned to receive a lower end of the coil spring 70 opposite the upper end. The cavity 90 is dimensioned to receive a lower half of the coil spring 70. The lower bushing 74 has a flange 92 surrounding an opening of the cavity 90 for contacting a portion of the upper surface of the flexible tip 14 surrounding the hole 86.

The coil spring 70 is preferably made of a metal, preferably spring steel. In other embodiments, however, the coil spring 70 may be replaced by an element having similar spring-like properties, such as a cylinder made of an elastomeric material (e.g., rubber). The upper bushing 72 and the lower bushing 74 made be made of, for example, metal or plastic. The dust cover 76 is preferably made of a flexible material such as rubber, fabric, plastic, or other suitable material.

In assembly, the body 80 of the upper bushing 72 is inserted into the hole 78 in the end of the rod 10 such that the flange 84 contacts the surface of the end of the rod 10 surrounding the hole 78. The upper end of the coil spring 70 is inserted into the cavity 82 of the upper bushing 72. The lower end of the coil spring 70 is inserted into the cavity 90 of the lower busing 74. The lower bushing 74 is inserted into the hole 86 of the flexible tip 14 such that the flange 92 contacts the portion of the upper surface surrounding the hole 86. The dust cover 76 surrounds the other components of the joint mechanism 12, preventing foreign matter such as dirt and liquids from contacting the other components of the joint mechanism 12.

Friction may be used to keep the upper bushing 72 in the end of the rod 10, the upper end of the coil spring 70 in the cavity 82 of the upper bushing 72, the lower bushing 74 in the flexible tip 14, and the lower end of the coil spring 70 in the cavity 90 of the lower bushing 74. Alternately, an adhesive material may be used at the above interfaces.

Figure 2:
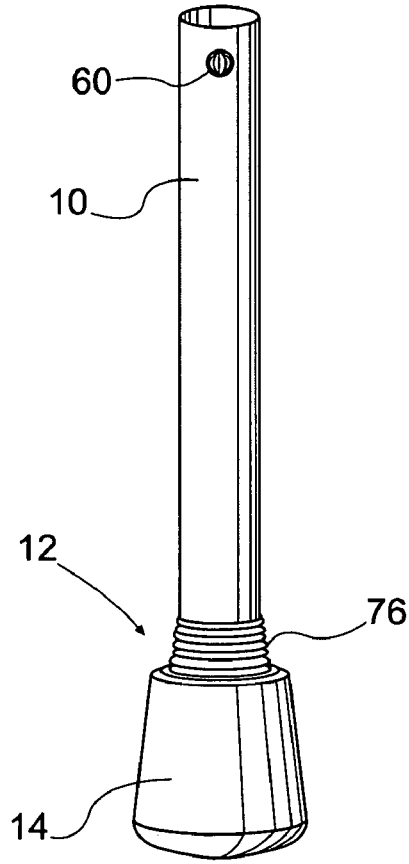
FIG. 2 is a side elevation view of the rod, the joint mechanism, and the flexible tip of FIG. 1 in assembly.

FIG. 2 is a side elevation view of the rod 10, the joint mechanism 12, and the flexible tip 14 of FIG. 1 in assembly. The dust cover 76 is shown operably covering the joint mechanism 12 to keep dust and other contamination which might otherwise damage the joint mechanism 12.

Figure 3:
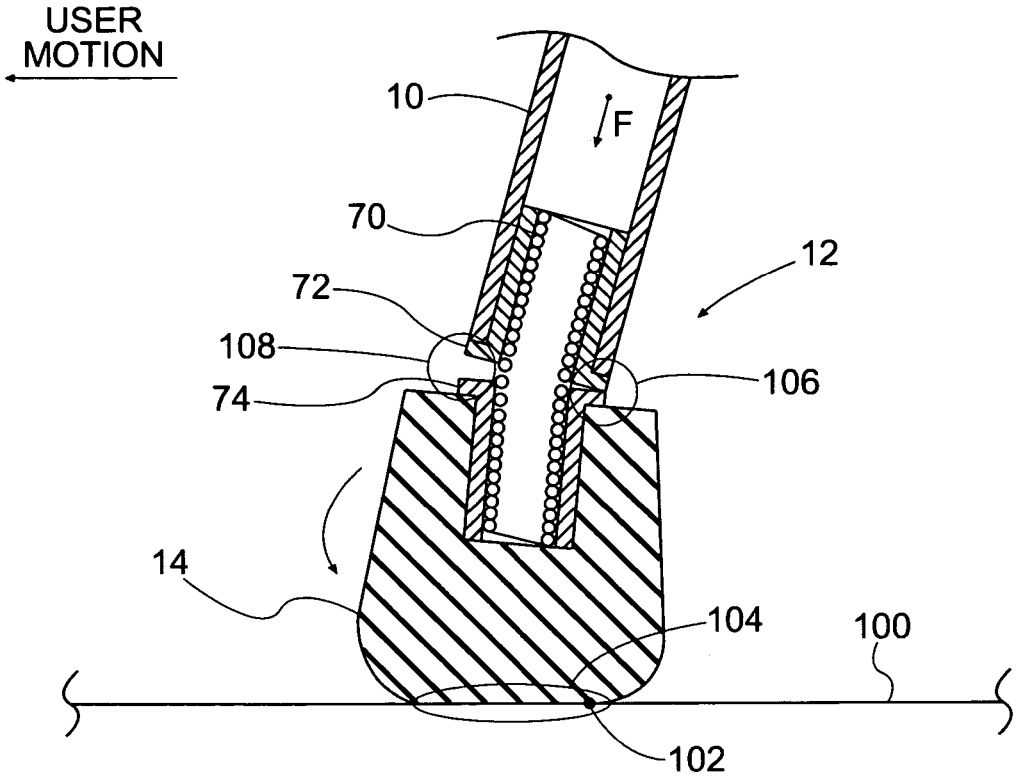
FIG. 3 is a diagram of the joint mechanism wherein a user is applying a force "F" to the rod, and wherein the flexible tip is in contact with a horizontal surface and extended out in front of the user in a direction of user motion.
Figure 4:
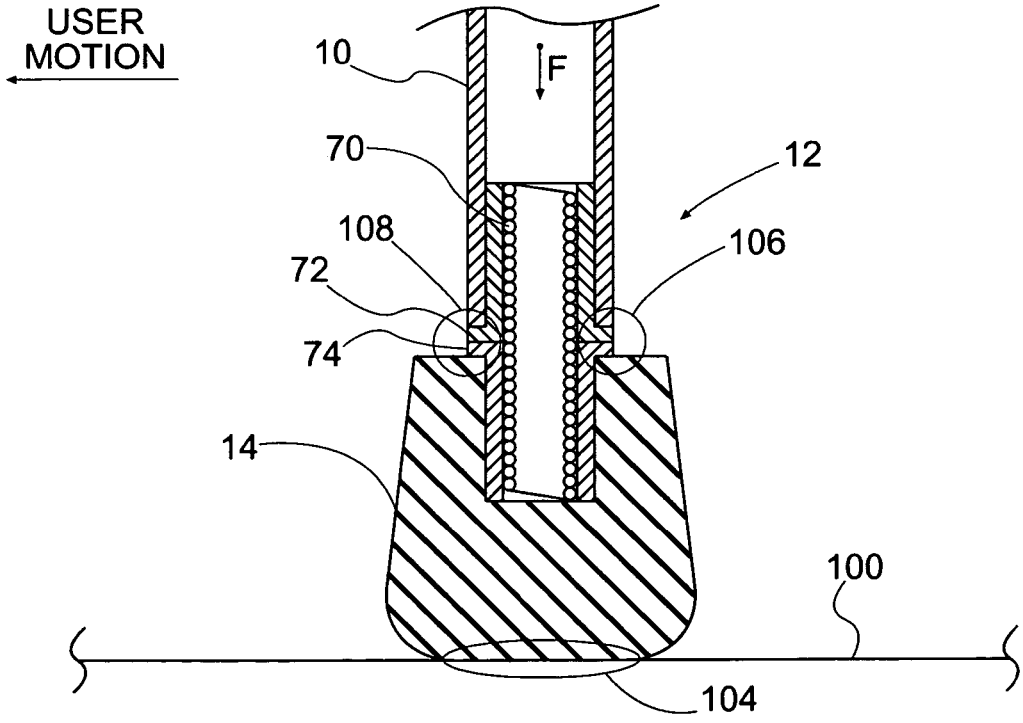
FIG. 4 is a diagram of the joint mechanism wherein the force F is substantially normal to the horizontal surface.
Figure 5:
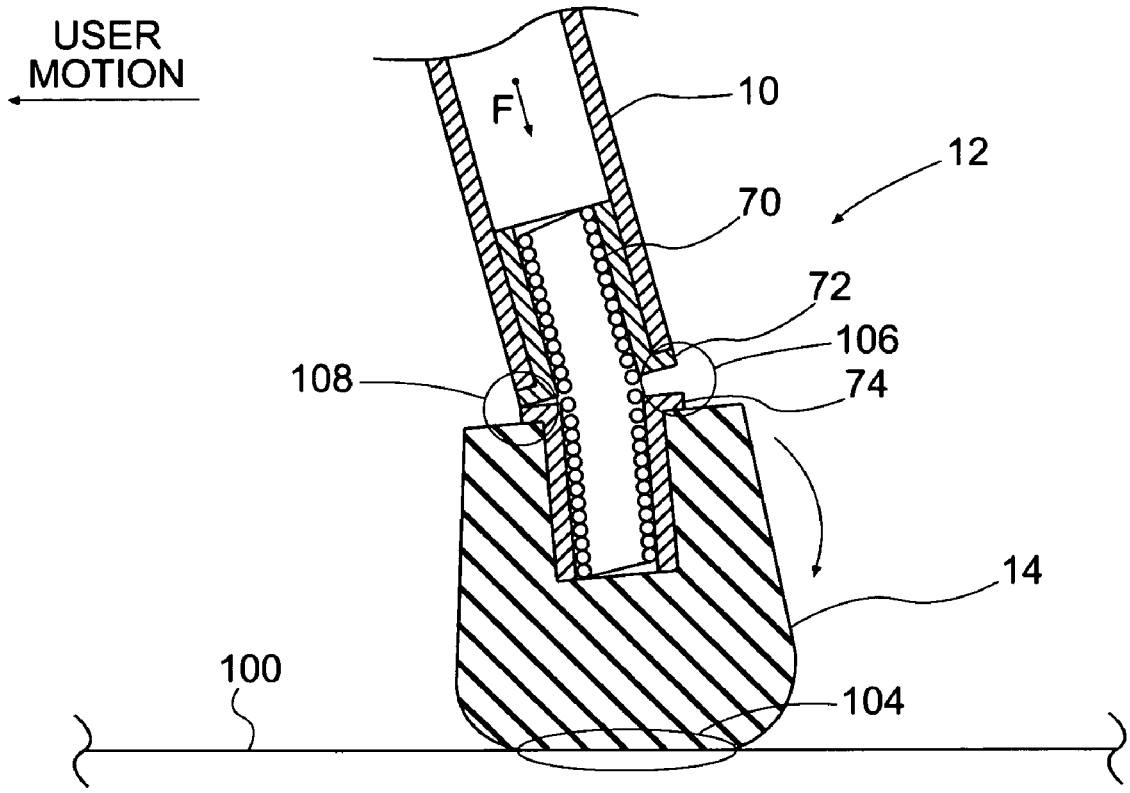
FIG. 5 is a diagram of the joint mechanism wherein the rod is extended out behind the user in a direction opposite the direction of user motion.

FIGS. 3-5 will now be used to describe how the joint mechanism 12 of FIG. 1 reduces the mechanical stiffness of the crutch 40 and improves the ability of the flexible tip 14 to grip horizontal surfaces. In these figures, the dust cover 76 has been removed for clarity. FIG. 3 is a diagram of a lower portion of the joint mechanism 12 of FIG. 1 wherein a user is applying a force "F" to the rod 10, and wherein the flexible tip 14 is in contact with a horizontal surface 100 and extended out in front of the user in a direction of user motion. The force F is expectedly some or all of a user's gravitational force, or weight. In FIG. 3, the force F is applied to an initial contact point 102, and causes the coil spring 70 to flex along its length (i.e., longitudinally). The upper bushing 72 and the lower busing 74 contact one another in a region 106 nearest the user and the initial contact point 102, and separate from one another in a region 108 farthest from the user and the initial contact point 102. The flexible tip 14 rotates about the region 106 as indicated in FIG. 3.

Several important actions are taking place in FIG. 3. First, the longitudinal flexing of the coil spring 70 appreciably mitigates any sudden impact between the flexible tip 14 and the horizontal surface 100. As a result, the mechanical stiffness of the crutch 40 is reduced. Second, the longitudinal flexing of the coil spring 70 and the rotating of the flexible tip 14 results in a contact area 104 between a bottom surface of the flexible tip 14 and the horizontal surface 100 that is larger than otherwise possible. As a result of the larger contact area 104, the maximum frictional force available to counteract the horizontal component of the force F is increased. The magnitude of the horizontal component of the force F required to cause the flexible tip 14 to slide along the horizontal surface 100 away from the user is increased. Accordingly, the user of the crutch 40 is less likely to lose control of the crutch 40, lose his or her balance in the process, and fall down.

FIG. 4 is a diagram of the lower portion of the joint mechanism 12 of FIG. 1 wherein the force F applied by the user to the joint mechanism 12 is substantially normal to the horizontal surface 100. In FIG. 4, the force F has no horizontal component, the coil spring 70 is not bent, and the flexible tip 14 is aligned with the rod 10. The upper bushing 72 and the lower busing 74 contact one another in both regions 106 and 108.

FIG. 5 is a diagram of a joint mechanism 12 wherein the crutch 40 is extended out behind the user in a direction opposite the direction of user motion. In FIG. 5, a horizontal component of the force F in the direction opposite the direction of user motion causes the coil spring 70 to flex longitudinally. The upper bushing 72 and the lower busing 74 contact one another in the region 108 now nearest the user, and separate from one another in the region 106 now farthest from the user. The flexible tip 14 rotates about the region 108 as indicated in FIG. 5.

As described above, the longitudinal flexing of the coil spring 70 and the rotating of the flexible tip 14 results in the contact area 104 between the bottom surface of the flexible tip 14 and the horizontal surface 100 being larger than otherwise possible. As a result of the larger contact area 104, the maximum frictional force available to counteract the horizontal component of the force F is increased. The magnitude of the horizontal component of the force F required to cause the flexible tip 14 to slide along the horizontal surface 100 away from the user is increased. Accordingly, the user of the crutch 40 is less likely to lose control of the crutch 40, lose his or her balance in the process, and fall down.

It is noted that the joint mechanism 12 may be used in a wide variety of walking aids having one or more rods for bearing some or all of a user's weight and corresponding flexible tips for contacting substantially horizontal surfaces, such as canes. The term walking aid is expressly defined to include a wide variety of crutches, canes, and related devices, as well as other devices such as stilts and related devices, toys, games, and other items.

Figure 6:
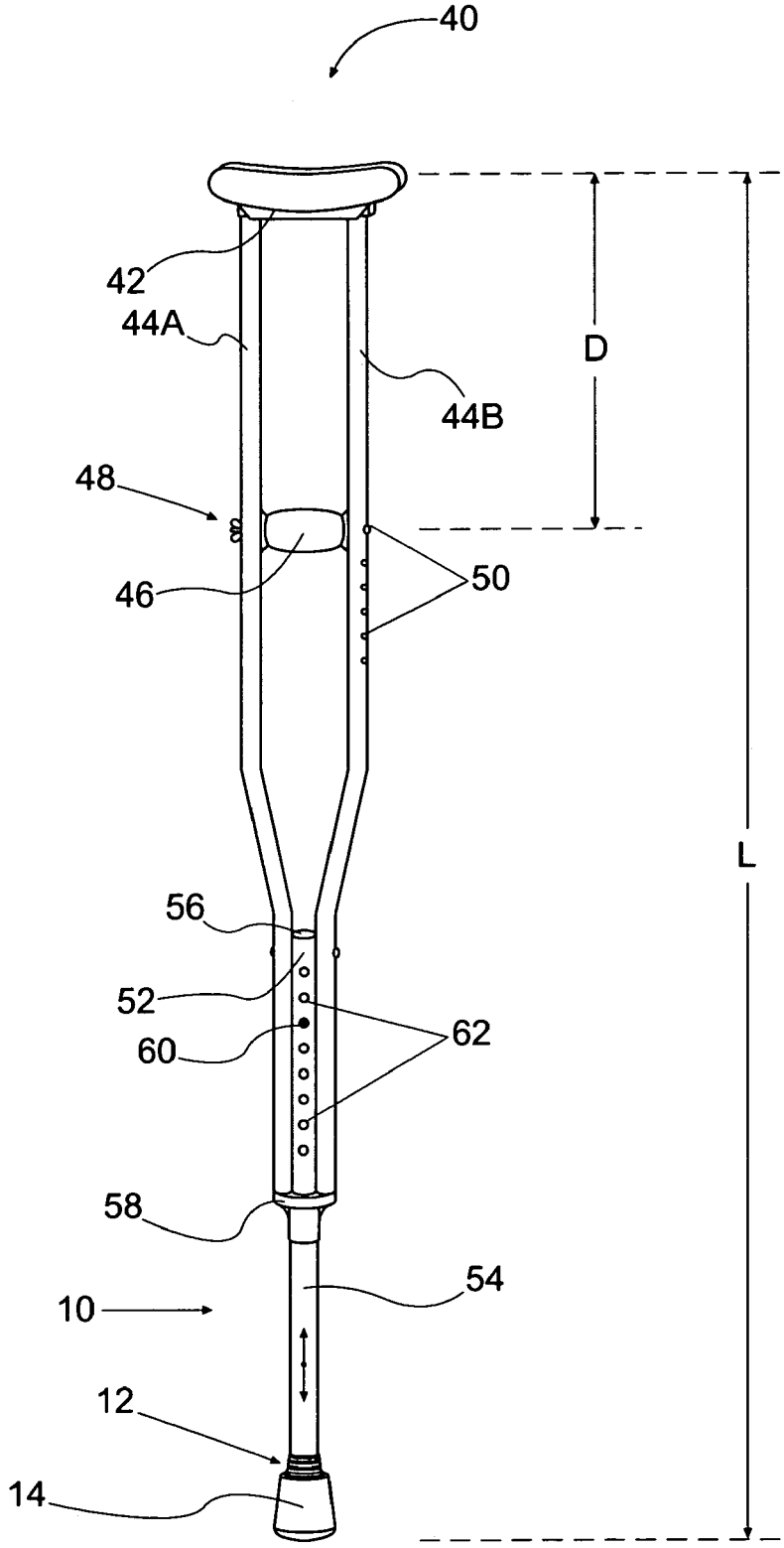
FIG. 6 is a side elevation view of an underarm crutch including the joint mechanism shown in FIGS. 1-5.

In one embodiment, as shown in FIG. 6, the joint mechanism 12 is used as part of an underarm crutch 40. As described above, the joint mechanism 12 reduces the mechanical stiffness of the crutch 40 and improves the ability of a flexible tip 14 to grip horizontal surfaces. The crutch 40 includes a padded underarm brace 42 having an underside surface connected to ends of two rods 44A and 44B. A padded hand grip 46 extends between the rods 24A and 24B. An adjustment mechanism 48, including a bolt and a wing nut allows a distance "D" between an upper edge of the padded underarm brace 42 and the hand grip 46 to be adjusted. The crutch 40 includes a rod 44B having a series of holes 50 extending therethrough. The rod 44A has a corresponding series of holes extending therethrough. The bolt of the adjustment mechanism 48 may be passed through any two corresponding holes in the rods 44A and 44B to adjust the distance D. It is noted that other types of crutches are known, including forearm crutches and platform crutches. The crutch 40 may also be, for example, a forearm crutch or a platform crutch. The rods 44A and 44B are preferably hollow cylinders or tubes made of a relatively light weight metal (e.g., aluminum).

A tube 52 is connected between ends of the rods 24A and 24B opposite the padded underarm brace 42. In this embodiment, the rod 10 fits inside the tube 52, and is adjustably connected to the tube 52 via a button lock adjustment mechanism. The rod 10 is telescopically extendable from the tube 52 via the button lock adjustment mechanism such that an overall length "L" of the crutch 40 may be adjusted. A plug 56 is positioned in the hole at one end of the tube 52, and a cap 58 is connected to the opposite end of the tube 52. The cap 58 is also connected to the ends of the rods 44A and 44B opposite the underarm brace 42. The rod 10 passes through a hole in the cap 58. An end of the rod 10 has a spring-loaded button 60 extending outward from an outer surface, and the tube 52 has a series of holes 62 dimensioned to receive the button 60. When the button 60 is positioned in one of the corresponding holes 62, the tube 52 and the rod 10 substantially rigidly connected or locked together. To vary the length L of the crutch 40, the button 60 positioned within one of the corresponding holes 62 is depressed, and the rod 10 is slipped into, or out of, the tube 52 until the spring-loaded button 60 pops into another one of the corresponding holes 62. The joint mechanism 12 is connected to an end of the rod 10 opposite the spring-loaded button 60, and the flexible tip 14 for contacting horizontal surfaces is connected to, and extends from, the joint mechanism 12.

Figure 7:
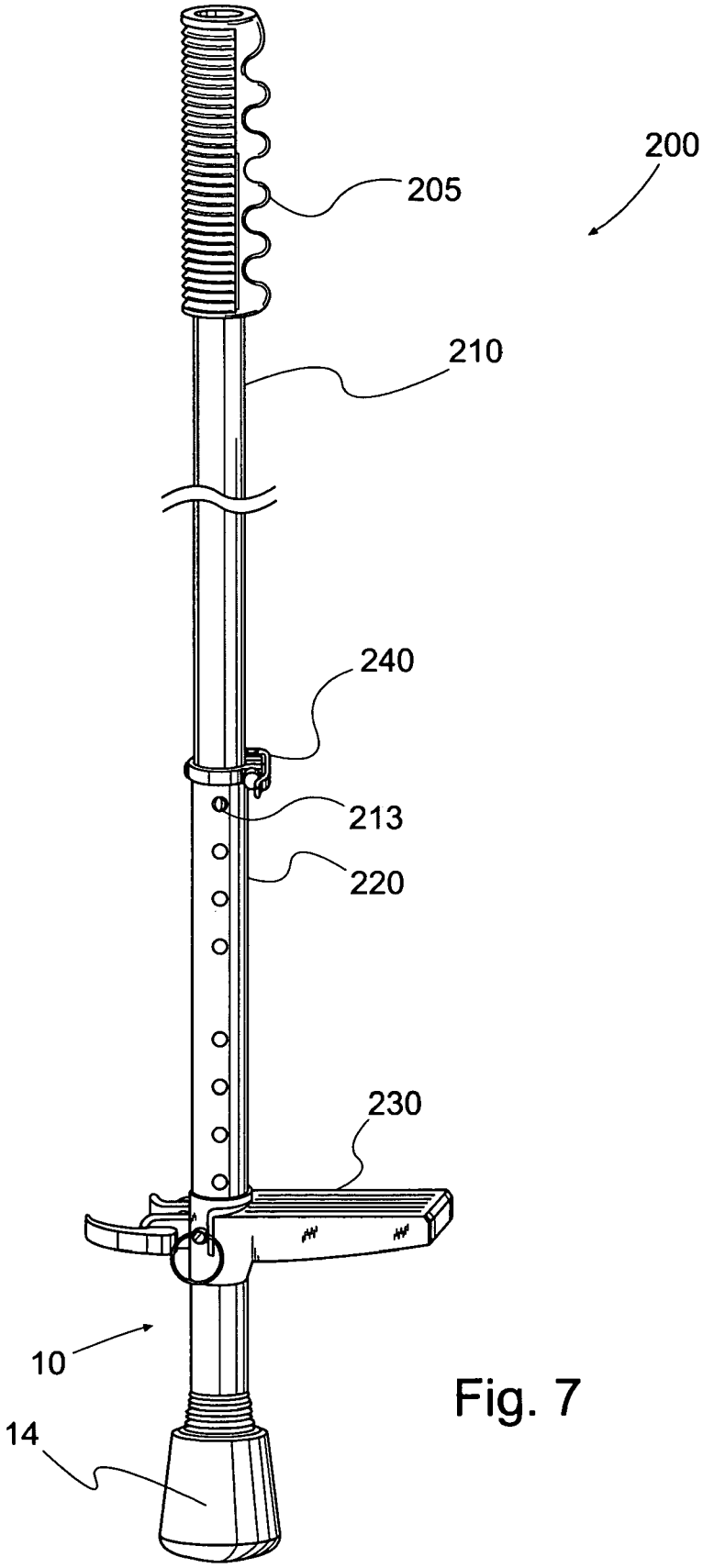
FIG. 7 us a perspective view of an adjustable stilt assembly including the joint mechanism shown in FIGS. 1-5.
Figure 8:
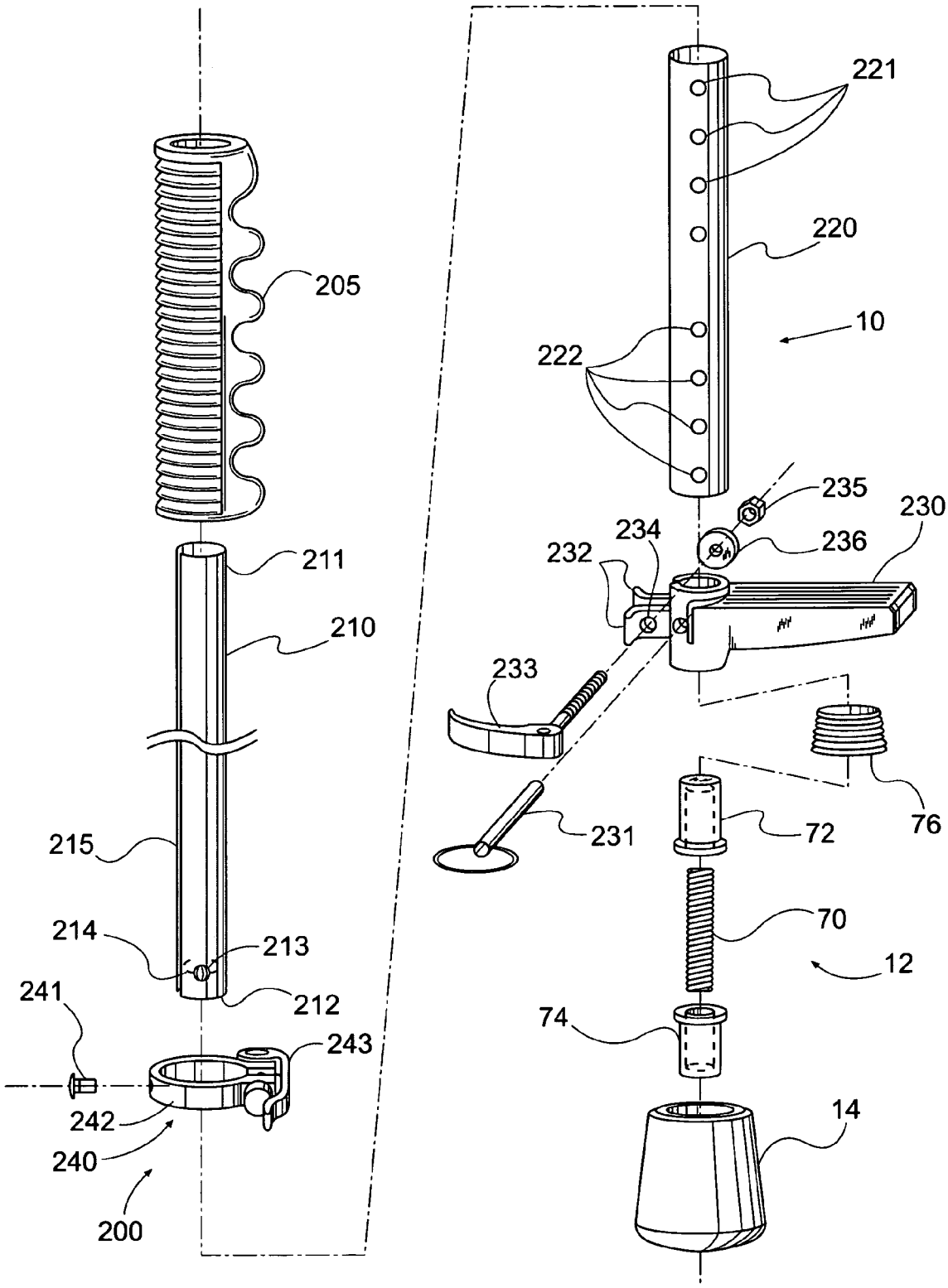
FIG. 8 is an exploded perspective view thereof.

In another embodiment, as shown in FIGS. 7 and 8, the rod 10 is part of an adjustable stilt assembly 200. As shown in FIG. 7, the adjustable stilt assembly 200 has an upper tube 210 and a lower tube 220 that telescopically engage each other so that the total height of the stilt assembly 200 can be adjusted. A handle portion 205 is preferably attached to the upper tube 210 to facilitate grasping the stilt assembly 20. Also included is a lateral foot peg mechanism 230 that is adapted to be adjustably mounted on the lower tube 220.

As shown in FIG. 8, the upper tube 210 includes an upper portion 211 that is adapted to fit into and frictionally engage the handle portion 205. The upper tube 210 also includes a lower portion 212 that includes an aperture adapted to hold a spring button 213 at the lower portion 212 of the upper tube 210. The spring button 213 is biased outwardly with a spring 214. The upper tube 210 preferably also includes a slot 215, whose use is described below.

The lower tube 220 has upper portion holes 221 and lower portion holes 222. The upper portion holes 301 are adapted for receiving the spring button 213 of upper tube 210 to fix the upper tube 210 within the lower tube 220. A quick release mechanism 240 is included to fix the upper tube 210 within the lower tube 220. A screw 241 of the quick release mechanism 240 fits into the furrow 215 of upper tube 210 so that the upper tube 210 cannot rotate with respect to the lower tube 220.

The quick release mechanism 240 includes a C-shaped base 242 that includes a clamping arm 243. The cam action of the clamping arm 243 functions to constrict the C-shaped base 242 and further lock the upper tube 210 with respect to the lower tube 220.

The lower portion holes 222 are adapted to engage a locking pin 231 of the lateral foot peg mechanism 230 to make the lateral foot peg mechanism 230 adjustable. The lateral foot peg mechanism 230 preferably further includes a pair of ears 232, each of the pair of ears 232 having a hole 234. Once the lateral foot peg mechanism 230 has been positioned, and the locking pin 231 has been inserted, a quick release locking arm/bolt 233 is inserted through the holes 234 and a washer 236 and a nut 235 are used to lock the quick release locking arm/bolt 233 in place. The cam action of the quick release locking arm/bolt 233 enables the user to tighten the lateral foot peg mechanism 230 on the lower tube 220.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A walking aid comprising:

a rod for bearing at least a portion of a user's weight;

a flexible tip for contacting a substantially horizontal surface; and a joint mechanism coupled between an end of the rod and the flexible tip and comprising a spring member, wherein the spring member flexes longitudinally when a force transmitted by the rod comprises a horizontal component, wherein the joint mechanism further comprises a first bushing positioned in a hole in the end of the rod, and wherein an end of the spring member is positioned in a cavity of the first bushing.

2. The walking aid as recited in claim 1, wherein the joint mechanism further comprises a second bushing positioned in a hole in the flexible tip, and wherein an opposite end of the spring member is positioned in a cavity of the second bushing.

3. A crutch, comprising:

a rod for bearing at least a portion of a user's weight;

a flexible tip for contacting a substantially horizontal surface; and a joint mechanism coupled between an end of the rod and the flexible tip, comprising:

a coil spring having opposed first and second ends, wherein the coil spring flexes longitudinally when a force transmitted by the rod comprises a horizontal component;

a first bushing positioned in a bole in the end of the rod and having a cavity adapted to receive the first end of the coil spring; and a second bushing positioned in a hole in the flexible tip and having a cavity adapted to receive the second end of the coil spring.

4. The crutch as recited in claim 3, wherein the longitudinal flexing of the coil spring reduces a mechanical stiffness of the crutch.

5. The crutch as recited, in claim 3, wherein the longitudinal flexing of the coil spring allows the flexible tip to rotate, and wherein the rotating of the flexible tip improves an ability of the flexible tip to grip the horizontal surface.

6. The crutch as recited in claim 3, further comprising a tube and a button lock adjustment mechanism, wherein the rod is positioned inside the tube and adjustably connected to the tube via the button lock adjustment mechanism.

7. The crutch as recited in claim 6, wherein the rod is telescopically extendable from the tube via the button lock adjustment mechanism.

8. The crutch as recited in claim 6, further comprising a pair of rods and an underarm brace, wherein one end of each of the pair of rods is connected to an underside surface of the underarm brace, and wherein an opposite end of each of the pair of rods is connected to the tube.

9. The crutch as recited in claim 8, further comprising a hand grip adjustably connected between the pair of rods.

* * * * *